US011560657B2

(12) United States Patent
Huang et al.

(10) Patent No.: US 11,560,657 B2
(45) Date of Patent: Jan. 24, 2023

(54) BRAIDING PATH GENERATING METHOD AND DEVICE USING THE SAME, AND DYNAMIC CORRECTING METHOD AND BRAIDING SYSTEM USING THE SAME

(71) Applicant: INDUSTRIAL TECHNOLOGY RESEARCH INSTITUTE, Hsinchu (TW)

(72) Inventors: Yi-Ping Huang, Taoyuan (TW); Shang-Kun Li, Taichung (TW); Yi-Tseng Li, New Taipei (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 9 days.

(21) Appl. No.: 17/316,995

(22) Filed: May 11, 2021

(65) Prior Publication Data

US 2022/0170191 A1 Jun. 2, 2022

(30) Foreign Application Priority Data

Dec. 2, 2020 (TW) ..... 109142364

(51) Int. Cl.
*D04C 3/40* (2006.01)
*D04C 3/48* (2006.01)

(52) U.S. Cl.
CPC ..... *D04C 3/40* (2013.01); *D04C 3/48* (2013.01)

(58) Field of Classification Search
CPC ... D04C 1/00; D04C 3/32; D04C 3/40; D04C 3/48
See application file for complete search history.

(56) References Cited

U.S. PATENT DOCUMENTS 2,365,691 A 12/1944 Fodor
3,410,073 A 11/1968 Brisken et al.
4,420,123 A 12/1983 Fox et al.
4,519,290 A * 5/1985 Inman ..... F02K 9/97 87/9
4,736,668 A 4/1988 Moyer
5,732,611 A 3/1998 Voyer et al.
5,904,087 A 5/1999 Freitas et al.
(Continued)

FOREIGN PATENT DOCUMENTS

CN 1955869 A 5/2007
CN 103901853 A 7/2014
(Continued)

OTHER PUBLICATIONS

Huang, "Composite Braiding Process and Its Applications" Airiti Library, May 1, 2020, pp. 60-68 (10 pages total), with English abstract.

(Continued)

*Primary Examiner* — Shaun R Hurley
(74) *Attorney, Agent, or Firm* — Birch, Stewart, Kolasch & Birch, LLP

(57) ABSTRACT

A braiding path generating method includes the following steps. Firstly, a mandrel model is received. Then, an outer diameter of the mandrel model is obtained. Then, a target braiding angle is obtained according to a target coverage rate and the outer diameter of the mandrel model. Then, a braiding simulation path is generated according to the target braiding angle.

12 Claims, 5 Drawing Sheets

(56) References Cited

U.S. PATENT DOCUMENTS

| | | | | |
|---|---|---|---|---|
| 7,835,567 | B2 * | 11/2010 | Oldani | B29C 70/382 382/152 |
| 7,975,591 | B2 | 7/2011 | Baeumer | |
| 8,006,601 | B2 | 8/2011 | Inazawa et al. | |
| 8,757,038 | B2 | 6/2014 | Siegismund | |
| 9,403,325 | B2 * | 8/2016 | Corradini | B65H 18/00 |
| 9,499,926 | B2 * | 11/2016 | Cohen | D03J 1/007 |
| 9,726,616 | B2 | 8/2017 | Mathon et al. | |
| 9,839,253 | B2 | 12/2017 | Bruce et al. | |
| 9,909,238 | B2 | 3/2018 | Wolf et al. | |
| 10,238,176 | B2 | 3/2019 | Bruce et al. | |
| 10,328,641 | B1 | 6/2019 | Johnson et al. | |
| 10,555,581 | B2 | 2/2020 | Bruce et al. | |
| 10,711,376 | B2 | 7/2020 | Hufenbach | |
| 2010/0037759 | A1 | 2/2010 | Baeumer | |
| 2013/0256447 | A1 | 10/2013 | Tanigawa et al. | |
| 2014/0034770 | A1 | 2/2014 | Sloupensky et al. | |
| 2015/0239181 | A1 | 8/2015 | Corradini et al. | |
| 2015/0287490 | A1 | 10/2015 | Spiegelhalder et al. | |
| 2016/0176673 | A1 | 6/2016 | Matsumoto et al. | |
| 2016/0243762 | A1 | 8/2016 | Fleming et al. | |
| 2018/0108826 | A1 | 4/2018 | Tajitsu et al. | |
| 2018/0178309 | A1 | 6/2018 | Inoue et al. | |
| 2018/0326590 | A1 | 11/2018 | Masuda et al. | |
| 2019/0031464 | A1 | 1/2019 | Feng | |
| 2019/0054639 | A1 | 2/2019 | Fujii et al. | |
| 2020/0317464 | A1 | 10/2020 | Mitsuhashi et al. | |
| 2021/0187816 | A1 * | 6/2021 | Li | B29C 53/8041 |
| 2022/0064831 | A1 * | 3/2022 | Budillon | G05B 19/4155 |

FOREIGN PATENT DOCUMENTS

| | | | |
|---|---|---|---|
| CN | 104252920 | A | 12/2014 |
| CN | 104532452 | A | 4/2015 |
| CN | 104574439 | A | 6/2015 |
| CN | 204855298 | U | 12/2015 |
| CN | 103668625 | B | 5/2016 |
| CN | 106436010 | A | 2/2017 |
| CN | 107324144 | A | 11/2017 |
| CN | 107604517 | A | 1/2018 |
| CN | 109402865 | A | 3/2019 |
| CN | 109623780 | A | 4/2019 |
| CN | 111326334 | A | 6/2020 |
| EP | 2 017 381 | B1 | 6/2012 |
| EP | 2 592 032 | A1 | 5/2013 |
| EP | 2 907 908 | A1 | 8/2015 |
| JP | 4492595 | B2 | 6/2010 |
| JP | 4973142 | B2 | 7/2012 |
| JP | 6460923 | B2 | 1/2019 |
| KR | 10-2015-0088963 | A | 8/2015 |
| TW | 101386 | | 7/1988 |
| TW | 436542 | B | 5/2001 |
| TW | 200530448 | A | 9/2005 |
| TW | M492921 | U | 1/2015 |
| TW | I531438 | B | 5/2016 |
| TW | 201632687 | A | 9/2016 |
| TW | 201802316 | A | 1/2018 |
| TW | I612914 | B | 2/2018 |
| TW | 201820106 | A | 6/2018 |
| TW | I629465 | B | 7/2018 |
| TW | M564181 | U | 7/2018 |
| TW | 201926024 | A | 7/2019 |
| WO | WO 2019/108509 | A | 6/2019 |

OTHER PUBLICATIONS

Taiwanese Office Action and Search Report for Taiwanese Application No. 109142364, dated Mar. 28, 2022.

U.S. Office Action for U.S. Appl. No. 17/013,426, dated Mar. 14, 2022.

"Carriers for braiding machines", Braiding Technology for Textiles, 2015, pp. 153-175.

Cluster of Excellence, Integrative Production Technology for High-Wage Countries, "Self-optimisation of the Radial Braiding Process", Self-optimising Production Systems, 2012, Total 7 pages.

European Search Report of application 20 19 8316 dated Mar. 5, 2021.

HANS et al., "Finite element simulation of the braiding process for arbitrary mandrel shapes", Composites: Part A, 2015, vol. 77, pp. 124-132.

Hu et al., "Tension modeling and analysis of braiding carriers during radial-direction and axial-direction braiding", The journal of The Textile institute, 2019, pp. 1-12.

Kuang, "Study on Stability in Filament Winding", 2009, Total 5 pages.

Lengersdorf et al, "Evaluation of Braiding as a Method for the Manufacturing of Composite Pressure Vessels", 20th International Conference on Composite Materials, 2015, Total 7 pages.

MA et al., "Modeling of the tensioning system on a braiding machine carrier", Mechanism and Machine Theory, 2012, vol. 47, pp. 46-61.

Maidl et al., "Development of a Novel Type of Online Monitoring System for the Braiding Process", ECCM18—18th European Conference on Composite Materials, 2018, pp. 1-9.

Pickett et al., "Comparison of analytical and finite element simulation of 2D braiding", Plastics, Rubber and Composites, 2009, vol. 38, No. 9/10, pp. 387-395.

Ravenhorst et al., "A yarn interaction model for circular braiding", Composites: Part A, 2016, vol. 81, pp. 254-263.

Ravenhorst, "Design Tools for Circular Overbraiding of Complex Mandrels", 2018, Total 278.

Roy et al., "Influence of Braid Carrier Tension on Carbon Fibre Braided Preforms", Springer International Publishing Switzerland 2016, pp. 91-102.

Sun et al., "Experimental and numerical studies on the braiding of carbon fibres over structured end-fittings for the design and manufacture of high performance hybrid shafts", Production Engineering, 2018, pp. 215-228.

Wu, "Design and Study for Filament Wound Composite Pressure Vessels", Jun. 2002, Total 86 pages.

European Office Action for European Application No. 20198316.0, dated Apr. 7, 2022.

United States Office Action for U.S. Appl. No. 16/985,845 dated Nov. 15, 2022.

* cited by examiner

BRAIDING PATH GENERATING METHOD AND DEVICE USING THE SAME, AND DYNAMIC CORRECTING METHOD AND BRAIDING SYSTEM USING THE SAME

This application claims the benefit of Taiwan application Serial No. 109142364, filed Dec. 2, 2020, the subject matter of which is incorporated herein by reference.

TECHNICAL FIELD

The disclosure relates in general to a braiding path generating method and a braiding path generating device using the same, and dynamic correcting method and braiding system using the same.

BACKGROUND

The braiding system is braided with wire materials on the mandrel, so that outer surface of the mandrel is covered with wire material to make a braided product or increase strength of the product. However, in terms of the mandrel with variable cross-sections, the wire coverage is usually difficult to be controlled within an expected range, and thus it may cause uneven strength of the final product.

SUMMARY

According to an embodiment, a braiding path generating method is provided. The braiding path generating method includes the following steps: a mandrel model is received; an outer diameter information of the mandrel model is obtained; a target braiding angle is obtained according to a target coverage rate and the outer diameter information of the mandrel model; and a braiding simulation path is generated according the target braiding angle.

According to another embodiment, a braiding path generating method is provided. The braiding path generating method includes the following steps: a mandrel is driven to move with a first operating parameter; a plurality of wire materials are driven to be braided on the mandrel with a second operating parameter; an actual coverage rate of the wire materials braided on the mandrel is obtained; whether the actual coverage rate meets a target coverage rate is determined; when the actual coverage rate does not meet the target coverage rate, an actual braiding angle of the wire materials is obtained according to the actual coverage rate; adjusted the first operating parameter and adjusted the second operating parameter are obtained according to the actual braiding angle; the mandrel is driven to move with the adjusted first operating parameter; and the wire materials are driven to be braided on the mandrel with the adjusted second operating parameter.

According to another embodiment, a braiding path generating device is provided. The braiding path generating device includes a mandrel model receiver and a path generator. The mandrel model receiver is configured to: receive a mandrel model. The path generator is configured to: obtain an outer diameter information of the mandrel model; obtain a target braiding angle according to a target coverage rate and the outer diameter information of the mandrel model; and generate a braiding simulation path according to the target braiding angle.

According to another embodiment, a braiding system is provided. The braiding system includes a driving device and a controller. The driving device is configured to drive a mandrel to move with a first operating parameter; drive a plurality of wire materials to be braided on the mandrel with a second operating parameter. The controller is configured to: obtain an actual coverage rate of the wire materials braided on the mandrel; determine whether the actual coverage rate meets a target coverage rate; when the actual coverage rate does not meet the target coverage rate, obtain an actual braiding angle of the wire materials according to the actual coverage rate; obtain adjusted the first operating parameter and adjusted the second operating parameter according to the actual braiding angle. The driving device is configured to: drive the mandrel to move with the adjusted first operating parameter; and drive the wire materials to be braided on the mandrel with the adjusted second operating parameter.

The above and other aspects of the disclosure will become better understood with regard to the following detailed description of the preferred but non-limiting embodiment (s). The following description is made with reference to the accompanying drawings.

Figure 1:
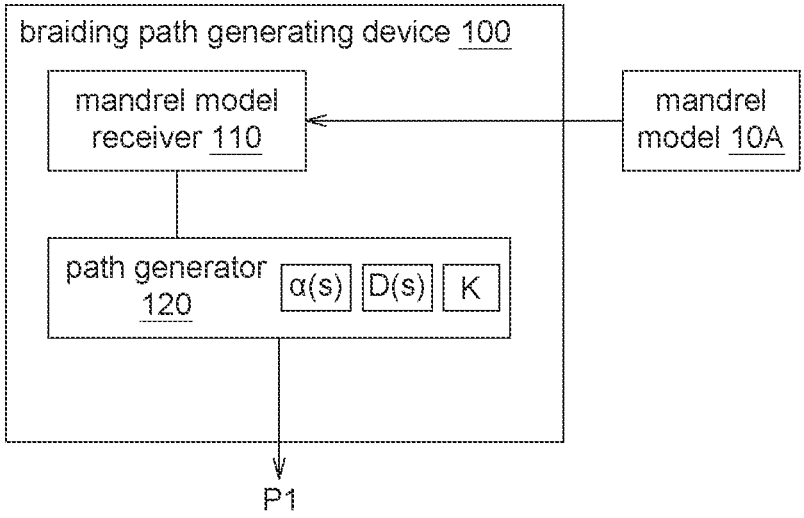
FIG. 1 shows a schematic diagram of a braiding path generating device according to an embodiment of the present disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DETAILED DESCRIPTION

Figure 2:
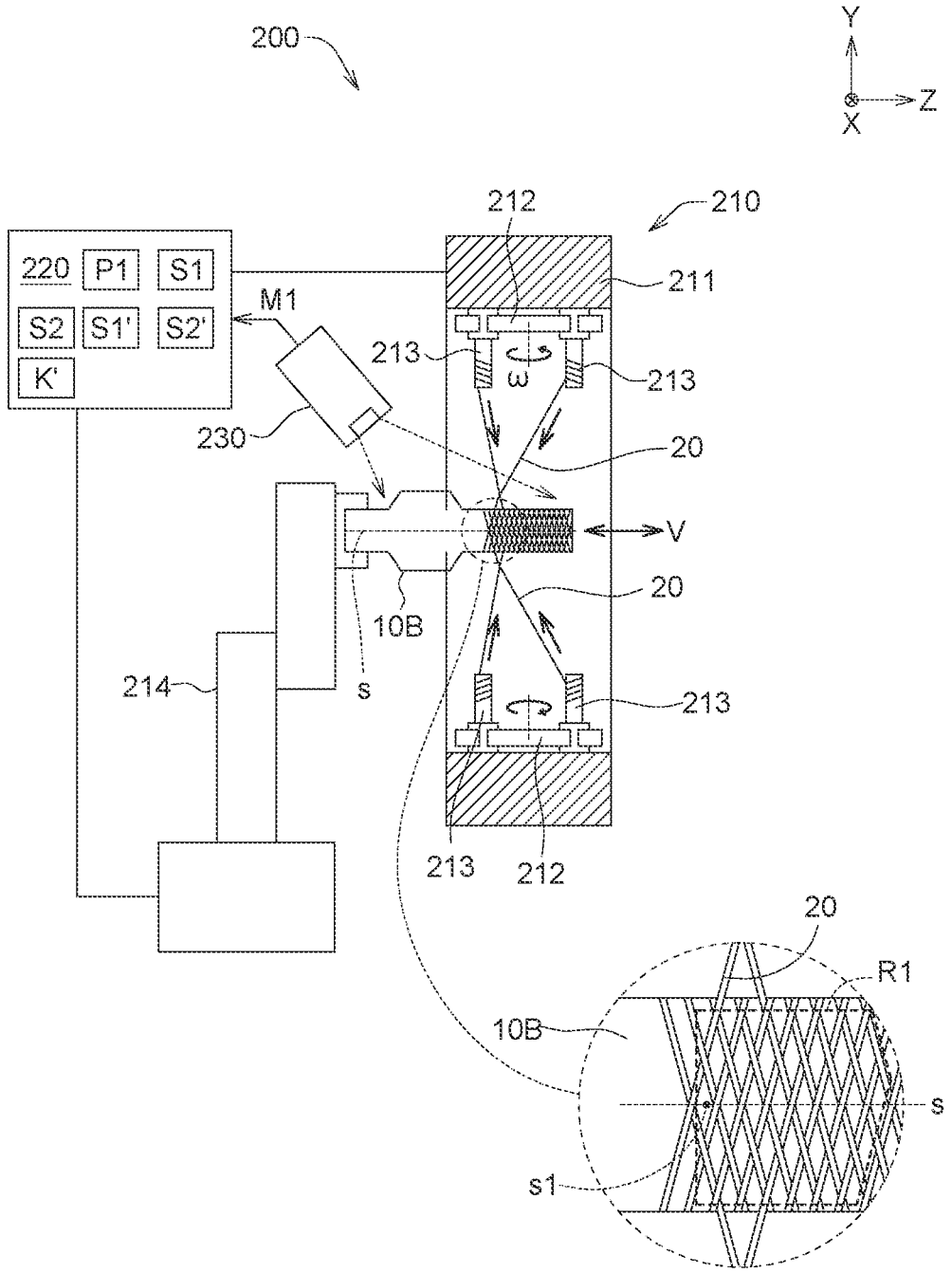
FIG. 2 shows a local schematic diagram of a braiding system using a wire braiding process according to an embodiment of the present disclosure.

Referring to FIGS. 1 and 2. FIG. 1 shows a schematic diagram of a braiding path generating device 100 according to an embodiment of the present disclosure, and FIG. 2 shows a local schematic diagram of a braiding system 200 using a wire braiding process according to an embodiment of the present disclosure.

The braiding path generating device 100 includes a mandrel model receiver 110 and a path generator 120. The mandrel model receiver 110 and/or the path generator 120 are, for example, physical circuits formed by a semiconductor manufacturing process, such as semiconductor chips, semiconductor packages or other types of circuit elements. In an embodiment, the mandrel model receiver 110 and the path generator 120 could be integrated into one single component, or at least one of the mandrel model receiver 110 and the path generator 120 could be integrated into a processor or controller, such as the controller 220 of the mandrel system 200 in FIG. 2. In an embodiment, the mandrel model receiver 110 is, for example, a Universal Serial Bus (USB) port; or, the mandrel model receiver 110 is, for example, a wireless communication unit which uses wireless communication technology to receive the mandrel model 10A.

As shown in FIG. 2, the braiding system 200 includes a driving device 210, a controller 220 and a coverage detector 230. The controller 220 is, for example, a circuit structure formed by a semiconductor process, such as a semiconductor chip, a semiconductor package or other types of circuit elements. The coverage detector 230 is, for example, a camera.

As shown in FIG. 2, the driving device 210 includes an outer ring 211, a plurality of transmission gears 212, a plurality of spindles 213 and a robotic arm 214. The transmission gear 212 is rotatably disposed on an inner surface of the outer ring 211. Each spindle 213 is wound with a wire material 20 which could provide the mandrel 10B for braiding. The spindle 213 is meshed with the transmission gear 212. When the transmission gear 212 rotates, it could drive all the spindles 213 to revolve, such as revolving around the Z axis. During the revolution of the spindle 213, the wire material 20 is pulled and braided on the mandrel 10B. The driving device 210 is configured to: (1) drive a mandrel 10B to move by a first operating parameter S1; and, (2) drive the wire material 20 to be braided on the mandrel 10B by a second operating parameter S2. In an embodiment, the first operating parameter S1 is, for example, a feed speed V of the mandrel 10B, such as speed along the Z axis, and the second operating parameter S2 is, for example, a rotation speed of the transmission gear 212. The robotic arm 214 drive the mandrel 10B to move according to the first operating parameter S1, so that the wire material 20 could be braided on different areas of the mandrel 10B. In addition, the robotic arm 214 has, for example, six degrees of freedom, such as translation (moves straight) along the X, Y, and Z axes and rotation around the X, Y, and Z axes. The robotic arm 214 with multiple degrees of freedom could drive the mandrel 10B with different or complex geometric shapes to increase the diversity of the final braiding products.

Referring to FIG. 1, the mandrel model receiver 110 is configured to receive the mandrel model 10A. The mandrel model 10A is, for example, a digital model built by a three-dimensional drawing software. The path generator 120 is configured to: (1). receive the mandrel model 10A; (2). obtain an outer diameter information D(s) of the mandrel model 10A; (3). obtain a target braiding angle α(s) according to a target coverage rate K and the outer diameter information D(s) of the mandrel model 10A; (4). generate a braiding simulation path P1 according to the target braiding angle α(s). In the disclosed embodiment, the target coverage rate K is used as the braiding target to determine the target braiding angle α(s) and generate the braiding simulation path P1, so that the actual coverage rate of the final braiding product meets the requirements, for example, the target coverage rate K.

After the braiding simulation path P1 is generated, the path generator 120 could output the braiding simulation path P1 to the braiding system 200. The braiding system 200 braids the mandrel 10B according to the braiding simulation path P1 to form the final braiding product.

In terms of product category, the mandrel 10B is, for example, a component of a transportation device (such as an airplane rack, a vehicle rack, a bicycle rack, etc.), and a component of a sports equipment (such as a badminton racket, a hockey handle, a boat paddle, etc.), the parts of people's livelihood products (such as liquefied petroleum gas bottles, hydrogen bottles, oxygen bottles, high-pressure barriers and high-pressure pipes) and other products that require high strength (but not limited). The wire material 20 is, for example, a composite material, such as a light-weight and high-strength wire such as carbon fiber and glass fiber. After the wire braiding operation for the mandrel 10B is completed, the mandrel 10B of the braided wire material 20 could be baked at a high temperature. The wire material 20 is formed of a wire body (supporting material) and resin (base material). After the wire material 20 is wrapped in the mandrel 10B, it needs to be baked at a high temperature to melt the resin first, and then combine with the wire body to form a composite material possessing the feature of high strength.

Figure 3:
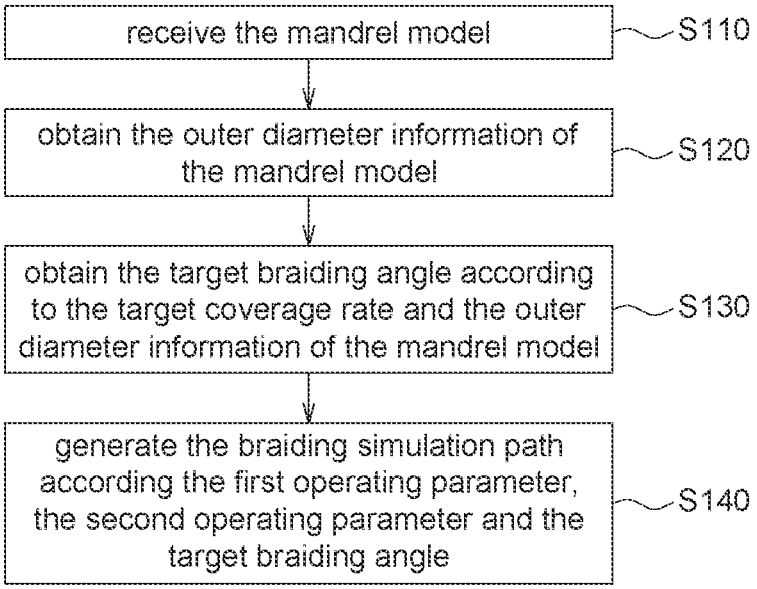
FIG. 3 shows a flow chart of the braiding path generating method of the braiding path generating device in FIG. 1.
Figure 4:
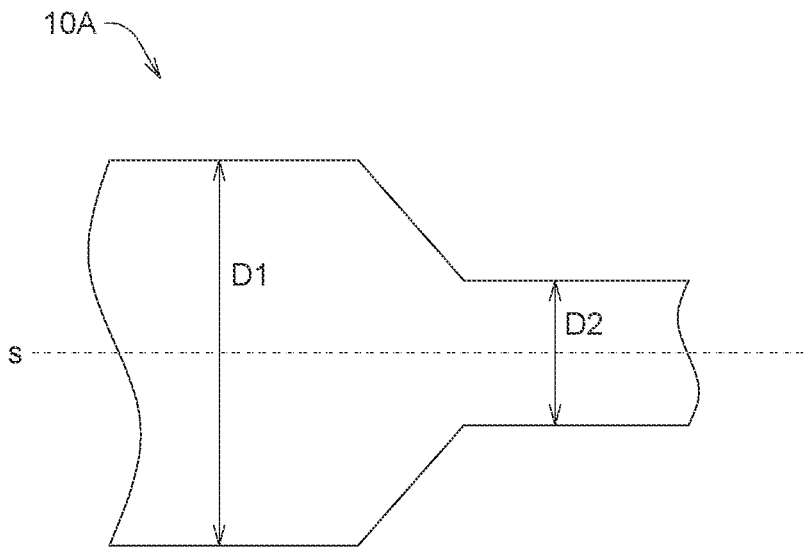
FIG. 4 shows a schematic diagram of the mandrel model according to another embodiment of the present disclosure.
Figure 5:
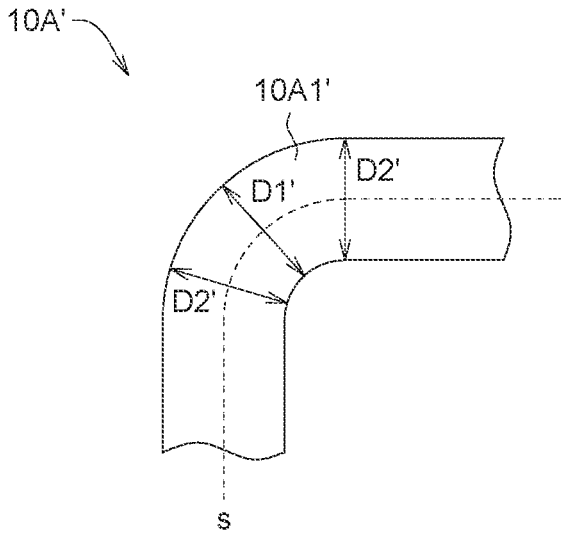
FIG. 5 shows a schematic diagram of the mandrel model 10A according to another embodiment of the disclosure.

Referring to FIGS. 3 to 5. FIG. 3 shows a flow chart of the braiding path generating method of the braiding path generating device 100 in FIG. 1, FIG. 4 shows a schematic diagram of the mandrel model 10A according to another embodiment of the present disclosure, and FIG. 5 shows a schematic diagram of the mandrel model 10A according to another embodiment of the disclosure. The method of generating the braiding simulation path P1 is described below with the flow chart in FIG. 3.

In step S110, the mandrel model receiver 110 receives the mandrel model 10A. The mandrel model 10A is, for example, a digital model (3D digital electronic file) built by a three-dimensional drawing software.

In step S120, the path generator 120 analyzes the mandrel model 10A to obtain the outer diameter information D(s) of the mandrel model 10A. D(s) includes an outer diameter value of the mandrel model 10A along the direction s, where s is an extending direction of the mandrel 10B. For example, as shown in FIG. 4, the cross section of the mandrel model 10A is variable along the extension direction s of the mandrel model 10A, wherein the extension direction s is a straight line direction, for example. The mandrel 10B has a first outer diameter D1 and a second outer diameter D2, wherein the first outer diameter D1 and the second outer diameter D2 are different. In another embodiment, as shown in FIG. 5, the cross section of the mandrel model 10A' is variable along the extension direction s of the mandrel model 10A', wherein the extension direction s is a curved direction. The aforementioned curve is, for example, a circular arc line, an ellipse line or a combined line of a straight line and a curved line. The mandrel model 10A' has a first outer diameter D1' and a second outer diameter D2', wherein the second outer diameter D2' is the outer diameter of the mandrel model 10A' at the turning portion, and the first outer diameter D1' is the inner diameter of the bent portion 10A1' of the mandrel model 10A, wherein the second outer diameter D2' is greater than the first outer diameter D1'. The geometry of the mandrel model of the embodiment of the disclosure is not limited by FIGS. 4 and 5.

In step S130, the path generator 120 obtains the target braiding angle α(s) according to the target coverage rate K and the outer diameter information D(s) of the mandrel model 10A.

In an embodiment, the target braiding angle α(s), is completed according to the following formula (1), where d is the diameter d of the strand of the wire material 20, C is the number of spindles 213, and N is the number of the strands of the wire material 20, K is the target coverage rate, and ω is the rotation speed of the transmission gear 212.

$$\alpha(s) = \cos^{-1}\left(\frac{N \cdot d \cdot C}{2\pi(D(s) + 2d)\left(1 - \sqrt{(1 - K)}\right)}\right) \quad (1)$$

It could be understood from equation (1) that the path generator 120 obtains the target braiding angle α(s) of the wire material 20 braided on the mandrel 10B according to the target coverage rate K, the outer diameter information D(s) of the mandrel model 10A, the number of the strands N, the number of the spindles C and the wire diameter d of the wire, wherein the target braiding angle α(s) may vary with position in the extension direction s.

Then, the path generator 120 obtains the target braiding angle α(s) according to the first operating parameter S1 and the second operating parameter S2 required to meet the target braiding angle α(s). For example, the path generator 120 could determine the feed speed V (the first operating parameter) of the mandrel and the rotation speed ω of the transmission gear 212 according to the following formula (2), where the feed speed V and the rotation speed w of the transmission gear 212 may vary with position in the extension direction s.

$$\tan\alpha(s) = \frac{\omega \cdot D(s)}{N \cdot V} \tag{2}$$

In step S140, the path generator 120 simulates the braiding process to generate the braiding simulation path P1 according to the target braiding angle α(s), the first operating parameter S1 and the second operating parameter S2.

Since the braiding system 200 of the disclosed embodiment uses the target coverage rate K as the braiding target to determine the target braiding angle α(s), it is capable of being applied to a mandrel model with variable cross-section, such as the mandrel model 10A shown in FIG. 4, the mandrel model 10A' shown in FIG. 5 or other geometrical mandrel models with variable cross-sections. The "variable cross section" herein means that the outer diameters of a number of the cross sections of the mandrel 10B are different from each other.

Figure 6:
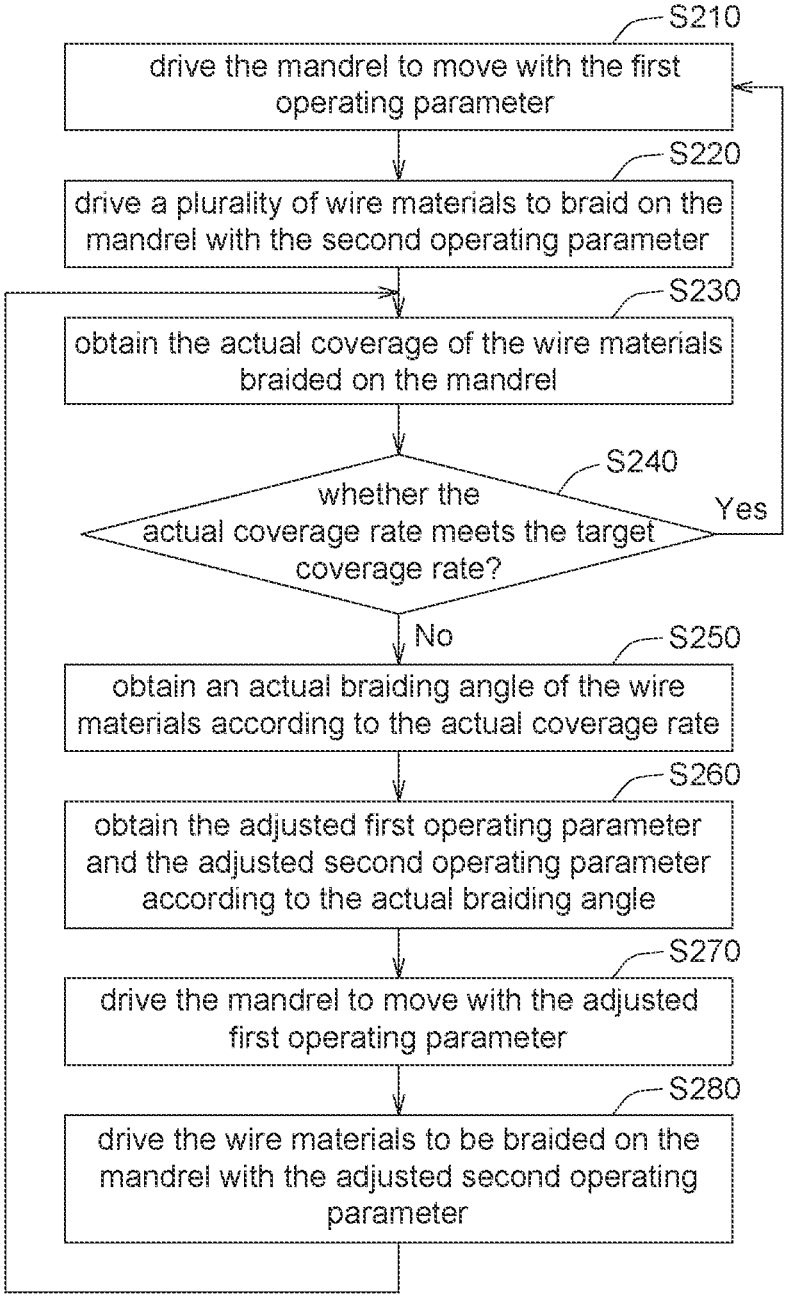
FIG. 6 shows a flow chart of the dynamic correcting method of the braiding system in FIG. 2.

Referring to FIG. 6, FIG. 6 shows a flow chart of the dynamic correcting method of the braiding system 200 in FIG. 2. In the actual braiding process, the braiding system 200 could monitor the braiding condition and dynamically correct the coverage rate that does not meet the expectations, so that the coverage rate of the final product is more even.

In step S210, as shown in FIG. 2, the controller 220 controls the driving device 210 to drive the mandrel 10B to move with the first operating parameter S1. For example, the controller 220 controls the robotic arm 214 of the driving device 210 at a position s1 of the mandrel 10B along the extension direction s, and drives the mandrel 10B to move with the first operating parameter S1 (for example, the feed speed V of the mandrel 10B). The present disclosure does not limit the specific position s1, and it could be any position to be analyzed along the extension direction s.

In step S220, as shown in FIG. 2, the controller 220 controls the driving device 210 to drive a plurality of wire materials 20 to be braided on the mandrel 10B with the second operating parameter S2. For example, the controller 220 controls the transmission gear 212 of the driving device 210 to drive a plurality of wire materials 20 to be braided on the mandrel 10B with the second operating parameter S2 (for example, rotation speed ω), for example, braided at the position s1 of the mandrel 10B along the extension direction s.

In step S230, the actual coverage rate K' of the wire materials 20 braided on the mandrel 10B is obtained. For example, the actual coverage rate K' of the wire material 20 braided at the position s1 of the mandrel 10B is obtained. In an method of obtaining the actual coverage rate K', for example, the coverage detector 230 captures the braiding image M1 of the mandrel 10B, and then the controller 220 analyzes the braiding image M1 to obtain the actual coverage rate K' of the wire material 20 braided on the mandrel 10B in the braiding image M1. As shown in the enlarged view of FIG. 2, the coverage rate could be defined as a ratio of the area of a region R1 of the mandrel 10B to a grid (or mesh) area covered by the wire material 20. The controller 220 could obtain the actual coverage rate K' by analyzing, using the image analysis technology, the ratio of the area R1 of the mandrel 10B in the braiding image M1 to the area of the grid that is not covered by the wire material 20.

In step S240, the controller 220 determines whether the actual coverage rate K' meets the target coverage rate K. When the actual coverage rate K' does not meet the target coverage rate K, the process proceeds to step S250; when the actual coverage rate K' meets the target coverage rate K, the process returns to step S210, and then the braiding system 200 continues to drive the wire material 20 to be braided on next position of the mandrel 10B along the extending direction s in accordance with the braiding simulation path P1.

In an embodiment, when an error between the actual coverage rate K' and the target coverage rate K is greater than a preset error, the controller 220 determines that the actual coverage rate K' does not meet the target coverage rate K. Conversely, when the error between the actual coverage rate K' and the target coverage rate K is not greater than the preset error, the controller 220 determines that the actual coverage rate K' meets the target coverage rate K.

In step S250, the controller 220 obtains an actual braiding angle α' of the wire materials 20 according to the actual coverage rate K'. Since the coverage rate and the braiding angle have one-to-one correspondence, if the actual coverage rate K' does not meet the target coverage rate K, it means that the actual braiding angle α' does not meet the target braiding angle α(s), and accordingly the actual braiding angle α' needs to be adjusted for correcting the actual braiding angle α' to meet the corresponding target braiding angle α(s). The reason why the actual braiding angle α' does not meet the target braiding angle α(s) may be: the difference between the first operating parameter S1 actually applied by the robotic arm 214 and the corresponding first operating parameter S1 in the braiding simulation path P1 is greater than an error range and/or the difference between the second operating parameter S2 applied by the transmission gear 212 and the corresponding second operating parameter S2 in the braiding simulation path P1 is greater than an error range. Therefore, as long as the first operating parameter S1 and the second operating parameter S2 corresponding to the target coverage rate are obtained, the driving device 210 could be controlled according to the first operating parameter S1 and the second operating parameter S2 to dynamically correct the unexpected (or unwanted/unintended) coverage rate in real time.

In step S260, the controller 220 obtains the adjusted first operating parameter S1 and the adjusted second operating parameter S2 according to the actual braiding angle α'. The obtaining method is, for example, the controller 220 could query the first operating parameter S1 and the second operating parameter S2 corresponding to the position s1 in the braiding simulation path P1 from the braiding path generating device 100, and use the queried first operating parameters S1 and the queried second operating parameter S2 respectively as the adjusted first operating parameter S1' and the adjusted second operating parameter S2'.

In step S270, the controller 220 drives the mandrel 10B to move with the adjusted first operating parameter S1'.

In step S280, the controller 220 drives the wire materials 20 to be braided on the mandrel 10B with the adjusted second operating parameter S2'.

Then, the process returns to step S230, and the braiding system 200, in the actual braiding process, continues to continuously monitoring and dynamically correcting the braiding abnormality in the mandrel 10B.

It will be apparent to those skilled in the art that various modifications and variations could be made to the disclosed embodiments. It is intended that the specification and examples be considered as exemplary only, with a true scope of the disclosure being indicated by the following claims and their equivalents.

What is claimed is:

1. A braiding path generating method, comprising:

receiving a mandrel model:

obtaining an outer diameter information of the mandrel model;

obtaining a target braiding angle according to a target coverage rate and the outer diameter information of the mandrel model; and generating a braiding simulation path according the target braiding angle.

2. The braiding path generating method according to claim 1, wherein in step of obtaining the target braiding angle, the target braiding angle is obtained according to following formula:

$$\alpha(s) = \cos^{-1}\left(\frac{N \cdot d \cdot C}{2\pi(D(s) + 2d)\left(1 - \sqrt{(1 - K)}\right)}\right);$$

wherein N is the number of a plurality of strands of a wire material, d is diameter of each of the strands, and C is the number of a plurality of spindles of the braiding system, each spindle is wound with one of the wire materials, α(s) is a target braiding angle, K is a target coverage rate, D(s) is the outer diameter information of the mandrel varying with s, and s is an extension direction of the mandrel.

3. The braiding path generating method according to claim 1, wherein the mandrel has variable cross-section.

4. A dynamic correcting method, comprising:

driving a mandrel to move with a first operating parameter;

driving a plurality of wire materials to be braided on the mandrel with a second operating parameter;

obtaining an actual coverage rate of the wire materials braided on the mandrel;

determining whether the actual coverage rate meets a target coverage rate;

when the actual coverage rate does not meet the target coverage rate, obtaining an actual braiding angle of the wire materials according to the actual coverage rate;

obtaining an adjusted first operating parameter and an adjusted second operating parameter according to the actual braiding angle;

driving the mandrel to move with the adjusted first operating parameter; and driving the wire materials to be braided on the mandrel with the adjusted second operating parameter.

5. The dynamic correcting method according to claim 4, wherein the mandrel has variable cross-section.

6. The dynamic correcting method according to claim 4, further comprises:

capturing a braiding image of the wire materials braided on the mandrel;

wherein the step of obtaining the actual coverage rate of the wire materials braided on the mandrel comprises:

obtaining the actual coverage rate by analyzing the braiding image.

7. A braiding path generating device, comprising:

a mandrel model receiver configured to:

receive a mandrel model;

a path generator configured to:

obtain an outer diameter information of the mandrel model;

obtain a target braiding angle according to a target coverage rate and the outer diameter information of the mandrel model; and generate a braiding simulation path according to the target braiding angle.

8. The braiding path generating device according to claim 7, wherein the path generator is further configured to, obtain the target braiding angle according to following formula:

$$\alpha(s) = \cos^{-1}\left(\frac{N \cdot d \cdot C}{2\pi(D(s) + 2d)\left(1 - \sqrt{(1 - K)}\right)}\right);$$

wherein N is the number of a plurality of strands of a wire material, d is diameter of each of the strands, and C is the number of a plurality of spindles of the braiding system, each spindle is wound with one of the wire materials, α(s) is a target braiding angle, K is a target coverage rate, D(s) is the outer diameter information of the mandrel varying with s, and s is an extension direction of the mandrel.

9. The braiding path generating device according to claim 7, wherein the mandrel model has variable cross-section.

10. A braiding system, comprising:

a driving device configured to:

drive a mandrel to move with a first operating parameter; and drive a plurality of wire materials to be braided on the mandrel with a second operating parameter;

a controller configured to:

obtain an actual coverage rate of the wire materials braided on the mandrel;

determine whether the actual coverage rate meets a target coverage rate;

when the actual coverage rate does not meet the target coverage rate, obtain an actual braiding angle of the wire materials according to the actual coverage rate; and obtain an adjusted first operating parameter and an adjusted second operating parameter according to the actual braiding angle;

wherein the driving device is configured to:

drive the mandrel to move with the adjusted first operating parameter; and drive the wire materials to be braided on the mandrel with the adjusted second operating parameter.

11. The braiding system according to claim 10, wherein the mandrel has variable cross-section.

12. The braiding system according to claim 10, further comprises:

a coverage detector configured to:

capture a braiding image of the wire materials braided on the mandrel;

wherein the controller is configured to:

obtain the actual coverage rate by analyzing the braiding image.

* * * * *